US006164567A

United States Patent [19]

Popov

[11] Patent Number: 6,164,567

[45] Date of Patent: Dec. 26, 2000

[54] GAS AND FLUID JET APPARATUS

[76] Inventor: Serguei A. Popov, 4615 Post Oak Pl., Suite 140, Houston, Tex. 77027

[21] Appl. No.: 09/355,770

[22] PCT Filed: Nov. 26, 1998

[86] PCT No.: PCT/IB98/01884

§ 371 Date: Aug. 4, 1999

§ 102(e) Date: Aug. 4, 1999

[87] PCT Pub. No.: WO99/28633

PCT Pub. Date: Jun. 10, 1999

[30] Foreign Application Priority Data

Dec. 4, 1997 [RU] Russian Federation ..... 97120001

[51] Int. Cl.[7] ..... E03C 1/08

[52] U.S. Cl. ..... 239/428.5; 239/434.5; 417/196; 417/151

[58] Field of Search ..... 239/428.5, 434.5, 239/433; 417/196, 151

[56] References Cited

U.S. PATENT DOCUMENTS

| | | | |
|---|---|---|---|
| 2,382,391 | 8/1945 | Berman . | |
| 3,625,820 | 12/1971 | Gluntz | 417/151 |
| 3,938,738 | 2/1976 | Nagel et al. | 239/428.5 |
| 4,419,074 | 12/1983 | Schuetz | 417/196 |
| 4,940,392 | 7/1990 | Adkins | 417/196 |
| 5,165,602 | 11/1992 | Arnout et al. | 239/434.5 |
| 5,628,623 | 5/1997 | Skaggs . | |

FOREIGN PATENT DOCUMENTS

| | | |
|---|---|---|
| 985462 | 12/1982 | U.S.S.R. . |
| 1483106 | 5/1989 | U.S.S.R. . |
| 1755714 | 8/1992 | U.S.S.R. . |

OTHER PUBLICATIONS

Shumski K. P., "Vacuum apparatuses and instruments"book, 1963, USSR, Moscow, "Mashgiz"Publishing house, pp. 476–477.

Sokolov E. Y., "Jet apparatuses"book, 1970, USSR, Moscow, "Energy"Publishing house, p. 209.

*Primary Examiner*—Andres Kashnikow
*Assistant Examiner*—Dinh Q. Nguyen
*Attorney, Agent, or Firm*—Mark A. Oathout

[57] ABSTRACT

The present invention relates to the field of jet technology.

According to the invention the ration between the surface area of the minimal cross-section of the mixing chamber and the surface area of the minimal cross-section of the active liquid nozzle is more than 800 but less than 1600.

A jet apparatus with the stated above correlation of sizes has an increased efficiency factor due to reduced energy losses.

1 Claim, 1 Drawing Sheet

GAS AND FLUID JET APPARATUS

TECHNICAL FIELD

This invention pertains to the field of jet technology, primarily to liquid-gas jet apparatuses for producing a vacuum.

BACKGROUND ART

Liquid-gas jet apparatuses are known, which contain an active nozzle, a receiving chamber, a mixing chamber, a diffuser and manifolds for active and passive mediums' feed (see "Vacuum apparatuses and devices", book of K. P. Shumski, M., Mashgiz, 1963, pages 476–477).

However such jet apparatuses have a comparatively low efficiency factor which narrows their application range.

The closest analogy to the described one is a liquid-gas jet apparatus, which comprises an active nozzle and a mixing chamber with a diffuser. An optimum ratio of sizes of the mixing chamber and the active nozzle is determined as a function of the ratio between the differential pressures of a mediums' mixture and an active liquid medium (see "Jet apparatuses", book of E. Y. Sokolov, M., Energy, 1970, page 209).

Conducted research efforts show that these apparatuses do not provide the required capacity and, in certain cases, the required depth of vacuum. The said limitations are connected with big energy losses during the mediums' mixing process.

SUMMARY OF INVENTION

The problem to be solved in this invention is an increase of efficiency factor of a liquid-gas jet apparatus due to optimisation of the process of gaseous and liquid mediums' mixing in the flow-through channel of the jet apparatus.

The above mentioned problem is solved as follows: a liquid-gas jet apparatus comprising an active nozzle and a mixing chamber has the ratio of the surface area of the minimal cross-section of the mixing chamber to the surface area of the minimal cross-section of the active liquid nozzle as more than 800 but less than 1600.

The effected research has shown, that arrangement of the mixing process of an active (ejecting) liquid medium and a passive (evacuated) gaseous medium significantly impacts the efficiency factor of the liquid-gas jet apparatus, because the biggest energy losses, in the first place, hit losses, take place at the moment of the first contact of the highly dynamic liquid medium with the unformed evacuated gaseous medium. Therefore the major attention is given to the correlation of sizes of the minimal cross-section—an outlet cross-section as a rule—of the active nozzle and the minimal cross-section of the mixing chamber. The liquid-gas jet apparatus for producing a vacuum with the stated above correlation of sizes of the mixing chamber and the active nozzle allows one to create such conditions, when highly dispersed liquid flow, on the one hand, provides effective evacuation of gaseous and vapor mediums and, on the other hand, blocks the throat of the mixing chamber preventing reverse flows from the outlet of the jet apparatus. At the same time, the situation is prevented, when the liquid flow, having insufficient energy level near the walls of the mixing chamber, forms eddy regions at the entrance zone of the chamber. Appearance of said eddy regions creates additional hydraulic resistance and results in additional energy consumption.

In this manner it becomes possible to decrease energy losses at the entrance zone of the mixing chamber without abatement of the jet apparatus' operational stability and, as a result, to increase the efficiency factor of the jet apparatus.

BRIEF DESCRIPTION OF DRAWINGS

The described liquid-gas jet apparatus is presented in FIG. 1.

DETAILED DESCRIPTION

Figure 1:
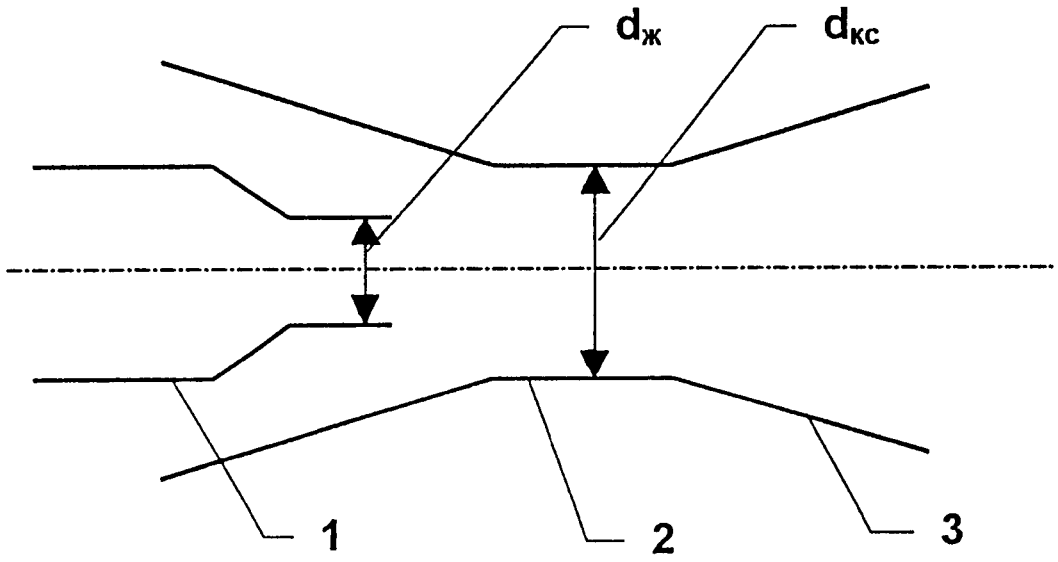

The liquid-gas jet apparatus comprises an active liquid nozzle 1, a mixing chamber 2 and a diffuser 3. The ratio of the surface area of the minimal cross-section $d_{kc}$ of the mixing chamber 2 to the surface area of the minimal cross-section $d_x$ of the active liquid nozzle 1 is more than 800 but less than 1600. In case the jet apparatus has a multi-channel active liquid nozzle 1, "the surface area of the minimal cross-section of the active nozzle" means the total surface area of the minimal cross-section of all channels of the nozzle 1.

The jet apparatus operates as follows.

An active liquid medium effusing from the nozzle 1 entrains a passive gaseous medium into the mixing chamber 2. Mediums' mixture from the mixing chamber 2 gets into the diffuser 3, where kinetic energy of the mixture is partially transferred into potential energy of pressure.

INDUSTRIAL APPLICABILITY

Apart from the petrochemical industry the described jet apparatus can be applied in many other industries, where compression of a gaseous medium by the use of kinetic energy of a liquid medium is required.

I claim:

1. A liquid-gas jet apparatus comprising an active liquid nozzle and a mixing chamber, wherein a ratio of the surface area of the minimal cross-section of the mixing chamber to the surface area of the minimal cross-section of the active liquid nozzle is more than 800 but less than 1600.

* * * * *